United States Patent [19]

Greaves

[11] Patent Number: 4,778,655

[45] Date of Patent: Oct. 18, 1988

[54] TREATMENT OF AQUEOUS SYSTEMS

[75] Inventor: Brian Greaves, Runcorn, England

[73] Assignee: W. R. Grace & Co., New York, N.Y.

[21] Appl. No.: 920,394

[22] Filed: Oct. 20, 1986

[30] Foreign Application Priority Data

Oct. 29, 1985 [GB] United Kingdom ..... 8526590

[51] Int. Cl.[4] ..... C23F 14/02

[52] U.S. Cl. ..... 422/15; 210/698; 252/181; 252/389.22; 252/389.23; 422/16; 422/17; 422/18

[58] Field of Search ..... 252/181, 389.22, 389.23; 210/698, 699; 422/15, 16, 17, 18

[56] References Cited

U.S. PATENT DOCUMENTS

| | | | |
|---|---|---|---|
| Re. 23,766 | 1/1954 | Bersworth | 562/449 |
| Re. 23,767 | 1/1954 | Bersworth | 562/452 |
| Re. 23,905 | 12/1954 | Bersworth | 562/448 |
| 2,249,757 | 7/1941 | Flett | 252/180 |
| 2,532,391 | 12/1950 | Bersworth | 210/698 |
| 2,624,757 | 1/1953 | Bersworth | 260/503 |
| 2,673,213 | 3/1954 | Bersworth | 210/698 |
| 2,717,263 | 12/1955 | McKinney et al. | 560/39 |
| 2,794,818 | 6/1957 | Bersworth | 556/116 |
| 2,967,196 | 1/1961 | Kroll et al. | 260/507 R |
| 3,005,848 | 10/1961 | Knell | 562/448 |
| 3,038,793 | 6/1962 | Kroll et al. | 71/1 |
| 3,110,679 | 11/1963 | Rubin | 252/152 |
| 3,293,176 | 12/1966 | White | 210/699 |
| 3,308,065 | 3/1967 | Lesinski | 252/82 |
| 3,394,174 | 7/1968 | Feigin | 260/509 |
| 3,463,799 | 8/1969 | Szava et al. | 556/45 |
| 3,490,741 | 1/1970 | Teumac et al. | 252/82 |
| 3,527,609 | 9/1970 | Vinso | 134/3 |
| 3,532,791 | 10/1970 | Johnston | 514/154 |
| 3,549,538 | 12/1970 | Jacklin | 252/82 |
| 3,669,901 | 6/1972 | Murray | 252/387 |
| 3,684,720 | 8/1972 | Richardson | 252/86 |
| 3,699,052 | 10/1972 | Petrey, Jr. et al. | 252/181 |
| 3,742,002 | 6/1973 | Ohlson et al. | 71/97 |
| 3,754,990 | 8/1973 | Teumac et al. | 134/2 |
| 3,794,603 | 2/1974 | O'Neal, Jr. et al. | 252/389 |
| 3,796,667 | 3/1974 | Block et al. | 252/180 |
| 3,806,459 | 4/1975 | Petry | 252/82 |
| 3,898,037 | 8/1975 | Lange et al. | 134/41 |
| 3,929,874 | 12/1975 | Beerman et al. | 252/192 |
| 3,965,027 | 6/1976 | Boffardi et al. | 252/180 |
| 3,988,367 | 10/1976 | Gaudette et al. | 562/565 |
| 4,011,171 | 3/1977 | Lorenc et al. | 252/180 |
| 4,018,701 | 4/1977 | Ralston et al. | 252/389 |
| 4,020,016 | 4/1977 | Sokol | 252/546 |
| 4,042,451 | 8/1977 | Lash et al. | 156/664 |
| 4,052,254 | 10/1977 | Harbulak et al. | 156/664 |
| 4,057,511 | 11/1977 | Bohnsack et al. | 252/181 |
| 4,069,249 | 1/1978 | Gaudette et al. | 260/519 |
| 4,130,582 | 12/1978 | Petree et al. | 562/448 |
| 4,144,185 | 3/1979 | Block | 252/180 |
| 4,152,345 | 5/1979 | Gaudette et al. | 260/439 R |
| 4,181,672 | 1/1980 | Popper et al. | 260/429 J |
| 4,190,463 | 2/1980 | Kaplan | 134/3 |
| 4,197,091 | 4/1980 | Gainer | 44/71 |
| 4,206,075 | 6/1980 | Boffardi | 252/181 |
| 4,209,398 | 6/1980 | Ii et al. | 252/181 |
| 4,225,502 | 9/1980 | Gaudette et al. | 260/465 E |
| 4,255,259 | 3/1981 | Hwa et al. | 210/699 |
| 4,338,460 | 7/1982 | Gaudette et al. | 562/448 |
| 4,374,733 | 2/1983 | Snyder et al. | 210/701 |
| 4,387,244 | 6/1983 | Scanlon et al. | 562/448 |
| 4,409,121 | 10/1983 | Latos et al. | 252/181 |
| 4,454,046 | 6/1984 | Wallace et al. | 210/698 |
| 4,497,713 | 2/1985 | Geiger | 252/181 |
| 4,566,972 | 1/1986 | Bennison et al. | 210/698 |
| 4,600,524 | 7/1986 | Cuisia et al. | 252/181 |
| 4,640,793 | 2/1987 | Persinski et al. | 210/698 |
| 4,663,053 | 5/1987 | Geiger | 210/699 |

FOREIGN PATENT DOCUMENTS

| | | | |
|---|---|---|---|
| 0006065 | 12/1979 | European Pat. Off. . | |
| 0102284 | 3/1983 | European Pat. Off. . | |
| 0212894 | 4/1987 | European Pat. Off. . | |
| 2236783 | 7/1971 | Fed. Rep. of Germany | 252/DIG. 11 |
| 18729 | 9/1985 | Philippines . | |
| 927841 | 6/1963 | United Kingdom . | |
| 1258067 | 12/1971 | United Kingdom . | |
| 1261554 | 1/1972 | United Kingdom . | |
| 1386718 | 3/1975 | United Kingdom . | |
| 1434804 | 5/1976 | United Kingdom . | |
| 1452557 | 10/1976 | United Kingdom . | |
| 1455247 | 11/1976 | United Kingdom . | |
| 1474362 | 5/1977 | United Kingdom . | |
| 2048961A | 3/1979 | United Kingdom . | |
| 1553156 | 9/1979 | United Kingdom . | |
| 2106492A | 8/1981 | United Kingdom . | |
| 2118159A | 10/1983 | United Kingdom . | |
| 2137185A | 10/1984 | United Kingdom . | |

OTHER PUBLICATIONS

Fitzgerald, "Rapid Identification of Common Chelants by Anion-Exchange Thin Layer Chromatography," Anal. Chem. 1975, 47(2), 356–7, (CA 82: 92711b).

McCutcheon's Functional Materials, 1983, p. 67.

*Primary Examiner*—Robert Wax

*Attorney, Agent, or Firm*—David E. Heiser

[57] ABSTRACT

A method of treating an aqueous system is disclosed which comprises adding thereto a water-soluble zinc salt, a chelant and either a product containing at least one phosphorous-containing acid group and at least one carboxylic acid group or an acrylic, vinyl or allyl carboxylic acid polymer.

36 Claims, No Drawings

TREATMENT OF AQUEOUS SYSTEMS

The present invention relates to the treatment of aqueous systems and, more particularly, to reducing or eliminating corrosion in aqueous systems.

Many different types of material have been employed to prevent or inhibit corrosion in aqueous systems. These include inorganic salts such as nitrites and chromates, inorganic mono and polyphosphates, certain water soluble polymers including naturally occurring materials such as lignins and starches as well as synthetic materials such as polyacrylates, as well as organic phosphonates. In addition, it is well known to use zinc salts for this purpose. Indeed, it is known to use zinc salts in combination with organic type corrosion inhibitors, principally organic phosphonates and polyacrylates.

The use of zinc salts enables one to passivate corrosion of the metal in contact with the system. It is generally believed that localised high concentrations of hydroxide ions rise at sites of corrosion on the metal surface because, due to the galvanic cell effect, oxygen present in the water is reduced to hydroxide ions at the cathodic sites. These hydroxide ions then react with zinc ions of the zinc salt to give zinc hydroxide which in turn yields a protective film on the metal surface.

While this passivation system works reasonably satisfactorily in some aqueous media it is known that the use of zinc salts, with or without the organic type corrosion inhibitor, is ineffective when the pH of the system is high, for example at pH from 8.2 to 9.0. Such a pH can be present when the water is hard, or is otherwise alkaline ie of low hardness and high alkalinity as can be the case with base exchanged water. Under such circumstances, the zinc hydroxide precipitates prematurely in the system water and therefore does not form a protective film over the metal. Thus in such systems the zinc actually becomes a foulant of the system. Similar problems arise when the temperature of the aqueous system is raised, for example to at least 40° C. as can occur when the aqueous system is used as cooling water which comes into contact with hot metal surfaces.

It has now surprisingly been found, according to the present invention, that more effective corrosion inhibition can be obtained when a zinc salt is used together with a class of phosphonate or similar material and, in addition, a chelant. It has been found that this combination is capable of being effective under a combination of severe pH and temperature conditions. It is considerably more effective than existing zinc/organic products on pre-corroded mild steel surfaces since the combination is capable of stifling existing corrosion as well as enabling much faster passivation of the rusty surface to be brought about. Thus the combination, as well as inhibiting corrosion, also acts as an on line cleaning agent by removing old rust.

According to the present invention there is provided a method of treating an aqueous system which comprises adding thereto a zinc salt, a chelant and either a product containing at least one phosphorus-containing acid group and at least one carboxylic acid group or an acrylic, vinyl or allyl carboxylic acid polymer.

Generally, any water soluble zinc salt can be used in the present invention. Typical salts which can be used include zinc sulphate, zinc chloride, zinc nitrate and zinc acetate, zinc sulphate monohydrate and zinc chloride being particularly preferred.

The third component used in the present invention will, in general, be a phosphonate. Preferably, the materials used contain at least two acid groups, one of which is a phosphonate group and the other is a carboxylic acid group, at least the two said acid groups being attached to carbon atoms.

Preferred phosphonates include hydroxy phosphonoacetic acid and 2-phosphono butane-1,2,4-tricarboxylic acid, the latter being particularly preferred. Thus these preferred phosphonates possess the general formula

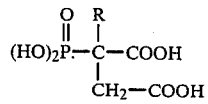

wherein R is hydrogen, alkyl, alkenyl or alkynyl having up to 4 carbon atoms; phenyl; cycloalkyl having 3 to 6 carbon atoms; benzyl; phenethyl or

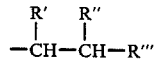

wherein R′ is hydrogen, alkyl having 1 to 4 carbon atoms or carboxyl, R″ is hydrogen or methyl and R‴ is carboxyl or phosphonate.

It is also possible to employ as the third component in the method a polymeric material and, in particular, carboxylic acid polymers which contain a chain phosphorus atom which forms part of an acid group. Thus these polymeric materials are preferably phosphino polycarboxylic acids, typically those having the formula

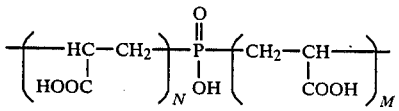

where N+M=4 to 20.

The molecular weight of such polymers is relatively low, generally below 5,000, the preferred molecular weight being from 250 to 750, especially about 500. A particularly suitable polymer is that sold as "Belclene 500" by Ciba-Giegy.

It has also been found that a synergistic effect, although most pronounced when the phosphorus containing materials are used, can also be obtained when a polycarboxylic acid is used, typically one having a molecular weight from 1,000 to 5,000. Such polymers may be derived from acrylic, vinyl or allyl carboxylic monomers, typically acrylic, methacrylic, maleic, fumaric, itaconic, crotonic or cinnamic acid alone or with a suitable comonomer. Such comonomers include acrylamide, (meth)acrylate esters or hydroxy esters e.g. hydroxypropyl esters, vinyl pyrrolidone, vinyl acetate, acrylonitrile, vinyl methyl ether, 2-acrylamido-2-methyl-propane sulphonic acid, vinyl or allyl sulphonic acid and styrene sulphonic acid as well as cationic monomers such as diallyl dimethyl ammonium chloride, dimethylamino ethylacrylate or methacrylate, optionally quaternised with, for example, dimethyl sulphate or methyl chloride.

The chelants which can be used in the method of the present invention are generally compounds with a nitrogen ligand which are effective chelants for iron. Usually, these chelants will also possess a carboxylic acid group. A preferred group of chelants possesses the formula

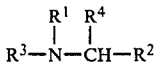

where $R^1$ is hydrogen, hydroxyethyl or carboxymethyl, preferably carboxymethyl, $R^2$ is hydrogen, hydroxyphenyl, preferably ortho-hydroxyphenyl, which is optionally methyl or sulphonic acid substituted, or carboxyl, $R^4$ is hydrogen or carboxyl, $R^3$ is

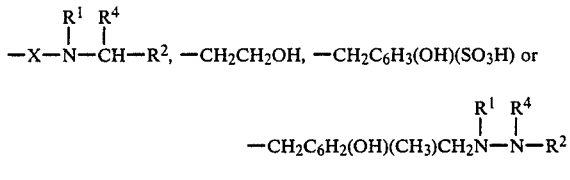

where $R^1$, $R^2$ and $R^4$ are as defined above and X is $-(CH_2)_2-$ or $-(CH_2)_3-$. The phenyl groups may be substituted, if desired, preferably by one or more halogen atoms.

If the chelant is to be used in aqueous systems which possess a high pH and a relatively high temperature it is preferred that at least one of $R^1$, $R^2$ and $R^3$ contains a hydroxyl group. Thus the most preferred chelants possess a nitrogen ligand, a carboxylic acid group and a hydroxyl group.

Preferred chelants for use in the present invention include N,N'-di(-2-hydroxybenzyl-)trimethylenediamine-N,N'-diacetic acid, N,N'ethylene-bis-[2-(2-hydroxy-4-methyl-phenyl)-glycine], ethylenediamine N, N'-bis-[2-hydroxyphenylacetic acid] and N, N-di(2-hydroxy-5-sulphonic acid benzyl)glycine which is especially preferred not only on account of its effectiveness but also on account of its excellent solubility properties which facilitate the formulation of compositions, as well as N,N-di(2-hydroxyethyl)glycine, N-hydroxyethyl N,N',N'-ethylenediamine triacetic acid and 2-hydroxyethyl iminodiacetic acid. Ethylenediamine tetraacetic acid and diethylene triamine pentaacetic acid can also be mentioned although they are less preferred since they do not contain a hydroxyl group (other than as part of the carboxylic acid groups).

In general, from 1 to 10 parts by weight of chelant and from 4 to 6 parts by weight of the phosphorus containing compound are employed to 1 part of the zinc salt. While in certain circumstances it may be desirable to add the individual components separately, in other situations it will be convenient to add the components together in the form of a composition. Accordingly, the present invention also provides a composition suitable for addition to an aqueous system which comprises a water soluble zinc salt, a product containing at least one phosphorus containing acid group and at least one carboxylic acid group or an acrylic, vinyl or allyl carboxylic acid polymer, and a chelant. In such a situation, it may be desirable to add further quantities of chelant as required. Typically, the composition will be an aqueous formulation containing, generally, 1% to 2% by weight of zinc salt (as zinc), 4% to 10% by weight of the phosphorus containing material or polymer and 1% to 25% by weight, especially about 5% by weight, of the chelant.

A further surprising feature of the present invention is that the presence of the combination of chelant and phosphorus containing compound and/or acrylic vinyl or allyl carboxylic acid polymer enables one to reduce the amount of zinc salt. It is usual in the art to employ amounts of the order of 2 to 5 ppm zinc. However, with ever increasing restrictions on concentrations of zinc in discharges there is a constant demand to reduce the amounts of zinc used. It has been found that by using the additional ingredients it is possible to reduce the amount of zinc to, say, about 1 ppm for comparable effectiveness. In such circumstances it is preferred to employ about 4 ppm of the phosphorus compound and about 2.5 to 5 ppm of chelant. If, on the other hand, one uses 2.5 ppm of zinc then it is preferred to use about 10 ppm of phosphorus compound and about 5 ppm of chelant.

It is also possible to use the combination of the present invention together with other ingredients including phosphates, biocides, yellow metal corrosion inhibitors such as benzotriazole and tolyltriazole as well as other polymers which act as dispersants such as polyacrylic acid, polymaleic acid and copolymers of maleic acid with styrene sulphonic acid. In particular, it has been found that the use of certain dispersants, especially a copolymer of methacrylic acid and acrylamide is particularly advantageous, especially one in which the mole ratio is about 1:3, and further enhances the corrosion protection given by the three component system. In general the molecular weight of the homopolymers will be 1,000 to 10,000 while that of the copolymers will be 1,000 to 50,000.

The use of a phosphate is particularly noteworthy since zinc phosphate is effective in low water hardness systems because the zinc phosphate itself gives protection. By using the chelant and phosphorus containing compound as well it is possible, as previously discussed, to use significantly lower quantities of zinc.

The following Examples further illustrate the present invention.

EXAMPLES 1 TO 34

In these Examples tests were carried out on a laboratory scale recirculating rig consisting of a plastic vessel holding 8 liters of water and connected by tubing to a circulating pump the water passing from the pump through a glass rack holding the metal test coupons ('line') and returning to the plastic vessel. Any evaporation was made up by the addition of de-ionised water. Metal test coupons were also suspended in the plastic vessel ('Pond'). The corrosion rate was calculated from the weight of metal lost during test. The water temperature was maintained by means of a heater/thermostat arrangement. The conditions of the test were as follows:

| | |
|---|---|
| System Water | 150 ppm Ca hardness/150 ppm 'M' Alkalinity |
| Water pH | 8.8 |
| Water Temperature | 54° C. or 40° C. (as stated) |
| Flow Rate: | |
| Line | 2 ft/sec |
| Pond | 0.2 ft/sec |
| Duration of Test | 3 days |
| Initial Passivation | 1 day at 3 times normal maintenance dose. |

Examples No. 1–14 were carried out at 40° C.

| Example No. | Additive | Dose, ppm | Corrosion of Mild Steel in mils per year (mpy) Line | Pond |
|---|---|---|---|---|
| 1 | No addition | | | |
| 2 | Zinc/Chelant 1/— | 2.2/5/— | 5.7 | 12.9 |
| 3 | Zinc/Chelant 1/Phosphonate 1 | 2.2/5/8.8 | 1.0 | 0.9 |
| 4 | Zinc/—/Phosphonate 1 | 2.2/—/8.8 | 7.8 | 3.3 |
| 5 | Zinc/Chelant 2/— | 2.2/5/— | 1.1 | 8.8 |
| 6 | Zinc/Chelant 2/Phosphonate 1 | 2.2/5/8.8 | 0.2 | 0.3 |
| 7 | Zinc/Chelant 3/— | 2.2/5/— | 1.5 | 2.4 |
| 8 | Zinc/Chelant 3/Phosphonate 1 | 2.2/5/8.8 | 1.1 | 1.6 |
| 9 | Zinc/Chelant 4/— | 2.2/5/— | 9.0 | 7.3 |
| 10 | Zinc/Chelant 4/Phosphonate 1 | 2.2/5/8.8 | 0.3 | 0.7 |
| 11 | Zinc/Chelant 5/— | 2.2/5/— | 10.7 | 12.9 |
| 12 | Zinc/Chelant 5/Phosphonate 1 | 2.2/5/8.8 | 1.9 | 8.6 |
| 13 | Zinc/Chelant 2/Phosphonate 2 | 2.2/5/8.8 | 4.5 | 4.8 |
| 14 | Zinc/Chelant 9/Phosphonate 1 | 2.2/5/8.8 | 0.2 | 0.2 |

Examples 1–14 illustrate:

(i) The blend of zinc/chelant/phosphonate is superior to zinc/phosphonate or zinc/chelant.

(ii) The preferred chelants are Chelants 1, 2, 3 and 9.

(iii) Phosphonate 1 gives significantly better results than comparative Phosphonate 2.

Examples 15–34 were carried out at 54° C.

| | | | | |
|---|---|---|---|---|
| 15 | Zinc/Chelant 2/Phosphino 1 | 2.2/5/8.8 | 2.9 | 5.3 |
| 16 | Zinc/Chelant 2/Phosphino 1 | 2.5/5/10.0 | 1.2 | 3.1 |
| 17 | Zinc/—/Phosphino 1 | 2.2/—/8.8 | 10.5 | 11.7 |
| 18 | Zinc/Chelant 2/Phosphonate 1 | 2.2/5/5 | 0.5 | 1.6 |
| 19 | Zinc/Chelant 2/Phosphonate 1 | 2.2/5/8.8 | 0.5 | 1.4 |
| 20 | Zinc/Chelant 2/Phosphonate 1/Polymer 1 | 2.2/5/8.8/2.5 | 0.4 | 0.9 |
| 21 | Zinc/Chelant 2/Phosphonate 3 | 2.2/5/8.8 | 0.4 | 0.5 |
| 22 | Zinc/Chelant 1/Phosphonate 1 | 2.2/5/8.8 | 1.2 | 5.0 |
| 23 | Zinc/Chelant 4/Phosphonate 1 | 2.2/5/8.8 | 2.3 | 5.6 |
| 24 | Zinc/Chelant 3/Phosphonate 1 | 2.2/5/8.8 | 1.6 | 2.4 |
| 25 | Zinc/Chelant 3/Phosphonate 1 | 1/5/4.4 | 2.1 | 5.2 |
| 26 | Zinc/Chelant 2/Polymer 2 | 2.2/5/10 | 5.2 | 9.1 |
| 27 | Zinc/—/Polymer 2 | 2.2/—/10 | 21.4 | 21.3 |
| 28 | Zinc/Chelant 2/Polymer 3 | 2.2/5/10 | 7.2 | 9.7 |
| 29 | Zinc/—/Polymer 3 | 2.2/—/10 | 17.7 | 32.2 |
| 30 | Zinc/Chelant 6/Phosphonate 1 | 2.2/5/8.8 | 3.1 | 3.4 |
| 31 | Zinc/Chelant 7/Phosphonate 1 | 2.2/5/8.8 | 3.2 | 2.1 |
| 32 | Zinc/Chelant 8/Phosphonate 1 | 2.2/5/8.8 | 3.6 | 6.8 |
| 33 | Zinc/—/Phosphonate 1 | 2.2/—/8.8 | 9.6 | 7.4 |
| 34 | Zinc/Chelant 9/Phosphonate 1 | 2.2/5/8.8 | 1.0 | 0.8 |

Chelant 1=N,N'-di(-2 hydroxybenzyl trimethylenediamine-N,N'-diacetic acid

Chelant 2=N,N' Ethylene-bis-[2(2-hydroxy-4 methylphenyl)-glycine]

Chelant 3=Ethylenediamine N,N'bis-[2 hydroxyl phenyl acetic acid]

Chelant 4=Ethylenediamine tetraacetic acid.

Chelant 5=N,N-di(2 hydroxy ethyl)glycine.

Chelant 6=N-Hydroxyethyl,N,N' Ethylenediamine triacetic acid.

Chelant 7=2-hydroxyethyl iminodiacetic acid.

Chelant 8=Diethylene triamine penta acetic acid.

Chelant 9=N,N-di(2 hydroxy-5-sulphonic acid benzyl)glycine

Phosphonate 1=2-Phosphonobutane 1,2,4 tricarboxylic acid.

Phosphonate 2=Hydroxy ethylidene di-phosphonic acid.

Phosphonate 3=Hydroxy phosphonoacetic acid.

Phosphino 1=Phosphino polyacrylic acid, M.Wt. approx 500 (sold commercially as "Belclene 500" Ciba Geigy).

Polymer 1=Copolymer of methacrylic acid/acrylamide, mole ratio 1:3, M.Wt. 35,000.

Polymer 2=Polyacrylic acid, M.Wt. 1000.

Polymer 3=Polyacrylic acid, M.Wt. 4500.

Examples 15–34 indicate:

(i) The excellent corrosion inhibiting properties of the zinc/chelant/phosphonate combinations are maintained at the higher test temperature; this is less marked with Chelant 8 which does not contain a hydroxy group (Example 32). The excellent corrosion inhibition is also maintained when the phosphonate is replaced by the phosphino-polycarboxylic acid in the 3 component combination.

(ii) The presence of Polymer 1, (Example 20), enhances the corrosion protection conferred by the 4 component blend over that given by the corresponding 3 component blend, (Example 19), without polymer.

(iii) The improvement brought about by the presence of the chelant with the zinc/polyacrylic acid combination.

EXAMPLES 35 TO 43

These Examples illustrate the effect of longer term tests. These are carried out on a laboratory scale simulated open, evaporative, recirculating cooling water system incorporating mild steel heat exchanger together with feed and bleed facilities which enable the system to run at a given concentration factor throughout the 14 day test. The test conditions were as follows:

| | |
|---|---|
| System Water | 160 ppm Calcium hardness<br>50 ppm Magnesium hardness<br>200 ppm 'M' Alkalinity |
| Water Temperature (Pond) | 50° C. |
| pH | 8.8 |
| Flow Rate through heat exchanger | 0.3 ft/sec |
| Flow Rate through coupon chamber | 1.5 ft/sec |
| Heat flux on exchanger | 75 $kj/m^{-2}/sec^{-1}$ |
| Duration of test | 14 days |
| Initial passivation | 3 × normal maintenance dose, allowed to decay from start of test. |

| Example No. | Additive | Dose, ppm | Corrosion Rate mpy Heat Exchanger | Coupon in line |
|---|---|---|---|---|
| 35 | Zinc/Chelant 2/Phosphonate 1 | 2.2/2.5/8.8 | 7.8 | 1.0 |
| 36 | Zinc/Chelant 2/Phosphonate 1 | 2.2/5/8.8 | 3.5 | 0.5 |
| 37 | Zinc/Chelant 2/Phosphonate 1 | 2.2/7.5/8.8 | 5.6 | 1.1 |
| 38 | Zinc/Chelant 2/Phosphonate 1 | 2.2/10/8.8 | 6.9 | 1.2 |
| 39 | Zinc/Chelant 4/Phosphonate 1 | 2.2/5/8.8 | 63.6 | 38.7 |
| 40 | Zinc/—/Phosphonate 1 | 2.2/—/8.8 | 9.5 | 1.0 |
| 41 | Zinc/Chelant 5/Phosphonate 1 | 2.2/5/8.8 | 4.6 | 1.8 |
| 42 | Zinc/0-phosphate/Chelant 2/Phosphonate 1 | 1.1/1.5/5/5 | 2.6 | 1.0 |
| 43 | Zinc/0-phosphate/Phosphonate 1 | 2.2/3.0/—/5 | 4.2 | 6.8 |

0-phosphate = disodium ortho-phosphate

It was noticed that when Chelant 2 was in use (Examples 35 to 38), the corrosion which initiated on the heat exchanger was rapidly stifled whereas in Example 40 corrosion spread throughout the test. Chelant 4 was largely ineffective; in fact, the results indicate aggression. This allows that this chelant is unsuitable where there is a heat exchanger giving a high surface temperature.

Example 42 in relation to Example 43 shows the effect of using Chelant 2 in enabling one to reduce the concentration of zinc/phosphate.

I claim:

1. In a method of treating an aqueous system to inhibit corrosion therein which comprises adding to the system water both a water-soluble zinc salt and at least one organic product selected from those consisting of (i) compounds containing at least one phorphorus-containing acid group and at least one carboxylic acid group, and (ii) polymers derived from acrylic acid, methacrylic acid, maleic acid, fumaric acid, itaconic acid, and crotonic acid, and having molecular weights from about 1000 to 5000, an improvement comprising: further adding at least one chelant possessing a nitrogen ligand, a carboxylic acid group and a hydroxyl group and selected from the group of chelants consisting of N,N-di(2-hydroxyethyl)glycine and compounds having the formula:

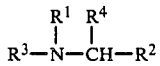

where $R^1$ is hydrogen or carboxymethyl, where $R^2$ is hydroxyphenyl which is optionally methyl or sulfonic acid substituted, where $R^4$ is hydrogen or carboxyl, where $R^3$ is

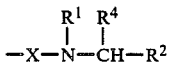

or $-CH_2C_6H_3(OH)(SO_3H)$, $R^1$, $R^2$, and $R^4$ being as defined above and X being $-(CH_2)_2-$ or $-(CH_2)_3-$, and where the phenyl groups of said compounds having said formula are optionally further substituted by one or more halogen atoms; the maintenance dose of said zinc in the system being from about 2.2 ppm to 5 ppm; the maintenance dose of said phosphorous containing compound and said polycarboxylic acids being from about 8.8 to 10 ppm, total; and the maintenance dose of said chelants being about 5 ppm.

2. An improved method according to claim 1 in which the zinc salt is zinc sulphate, zinc chloride, zinc nitrate or zinc acetate.

3. An improved method according to claim 1 in which the added organic product is a phosphonate containing at least two acid groups one of which is a phosphonate and the other is a carboxylic acid group, at least the two said acid groups being attached to carbon atoms.

4. An improved method according to claim 3 in which the phosphonate has the general formula

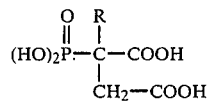

wherein R is hydrogen, alkyl, alkenyl or alkynyl having up to 4 carbon atoms; phenyl; cycloalkyl having 3 to 6 carbon atoms; benzyl; phenethyl or

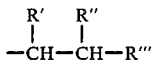

wherein R′ is hydrogen, alkyl having 1 to 4 carbon atoms or carboxyl, R″ is hydrogen or methyl and R‴ is carboxyl or phosphonate.

5. An improved method according to claim 4 in which the phosphonate is hydroxy-phosphonoacetic acid or 2-phosphonobutane-1,2,4-tricarboxylic acid.

6. An improved method according to claim 1 in which the product containing at least one phosphorus-containing acid group and at least one carboxylic acid group is a phosphino polycarboxylic acid having the formula

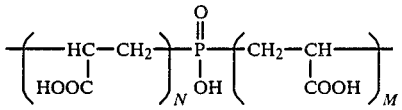

where N+M=4 to 20.

7. An improved method according to claim 1 or claim 2 in which the added organic product is a homopolymer.

8. An improved method according to claim 7 in which the polymer is a polyacrylic acid.

9. An improved method according to claim 1 in which the chelant is N,N′-di(2-hydroxybenzyl)trimethylenediamine-N,N′-diacetic acid, N,N′ethylenebis-[2-(2-hydroxy-4-methyl-phenyl)-glycine], ethylenediamine N,N′-bis-(2-hydroxyphenylacetic acid].

10. An improved method according to claim 1 in which 1 to 10 parts by weight of chelant are added per part by weight of the zinc salt.

11. An improved method according to claim 1 in which 4 to 6 parts by weight of the phosphorus and carboxylic acid group containing compound are added per part by weight of the zinc salt.

12. An improved method according to claim 1 in which a phosphate, a biocide, a yellow metal corrosion inhibitor selected from the group consiting of benzotriazole and tolyltriazole, or a dispersant is also added to the system water.

13. An improved method according to claim 12 in which the dispersant is a copolymer of methacrylic acid and acrylamide.

14. An improved method according to claim 3 in which the weight ratio of chelant present in the system water to zinc salt present in the system water is between about 10:1 and about 1:1.

15. An improved method according to claim 14 wherein compounds containing at least one phosphorous-containing acid group and at least one carboxylic acid group are present in the system water in a weight ratio to zinc salt present in the system water between about 4:1 and about 6:1.

16. An improved method according to claim 1 wherein the zinc salt, the organic product, and the chelant are added as an aqueous composition comprising from about 1% to 2% by weight of zinc, from about 1% to 25% by weight of chelant, and from about 4% to 10% by weight of organic product.

17. An improved method according to claim 1 wherein the system water attains a temperature of at least 40° C.

18. An improved method according to claim 17 wherein the system is a cooling water system in which the system water comes into contact with hot metal surfaces.

19. An improved method according to claim 1 wherein the system water attains a pH of 8.2.

20. An improved method according to claim 1 wherein the water has low hardness.

21. An improved method according to claim 20 wherein the system water is base exchanged prior to addition of the zinc salt, the organic product, and the chelant.

22. An improved method according to claim 1 wherein phosphate is also present in the system.

23. An improved method according to claim 1 wherein the chelant is N,N-di(2-hydroxyethyl)glycine.

24. A composition suitable for addition to an aqueous system which comprises: (a) a water-soluble zinc salt; (b) at least one chelant possessing a nitrogen ligand, a carboxylic acid group, and a hydroxyl group and selected from the group of chelants consisting of N,N-di(2 hydroxyethyl)glycine and compounds having the formula

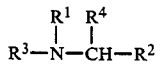

where $R^1$ is hydrogen or carboxymethyl, where $R^2$ is hydroxyphenyl which is optionally methyl or sulfonic acid substituted, where $R^4$ is hydrogen or carboxyl, where $R^3$ is

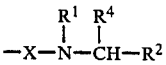

or $—CH_2C_6H_3(OH)(SO_3H)$, $R^1$, $R^2$, and $R^4$ being as defined above and X being $—(CH_2)_2—$ or $—(CH_2)_3—$, and where the phenyl groups of said compounds having said formula are optionally further substituted by one or more halogen atoms; and (c) at least one organic product selected from those consisting of (i) compounds containing at least one phosphorus-containing acid group and at least one carboxylic acid group, and (ii) polymers derived from acrylic acid, methacrylic acid, maleic acid, fumaric acid, itaconic acid, and crotonic acid, and having molecular weights from about 1000 to 5000; the weight ratio of component (a) to component (b) being from about 2.2 to 5 parts zinc to each 5 parts chelant; and the weight ratio of component (c) to component (b) being from about 8.8 to 10 parts organic product to each 5 parts chelant.

25. A composition according to claim 24 in which the zinc salt is zinc sulphate, zinc chloride, zinc nitrate or zinc acetate.

26. A composition according to claim 24 in which the product containing at least one phosphorus containing acid group and at least one carboxylic acid group has the general formula

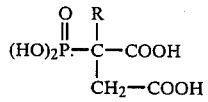

wherein R is hydrogen, alkyl, alkenyl or alkynyl having up to 4 carbon atoms; phenyl; cycloalkyl having 3 to 6 carbon atoms; benzyl; phenethyl or

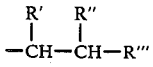

wherein R′ is hydrogen, alkyl having 1 to 4 carbon atoms or carboxyl, R″ is hydrogen or methyl and R‴ is carboxyl or phosphonate.

27. A composition according to claim 24 in which the organic product is a polyacrylic acid.

28. A composition according to claim 24 which is aqueous.

29. A composition according to claim 16 which contains 1 to 2% by weight of zinc salt (as zinc), 4 to 10% by weight of the phosphorus and carboxylic acid group containing material or polymer and 1 to 25% by weight of the chelant.

30. A composition according to claim 24 which also comprises a phosphate, a biocide, benzotriazole, tolytriazole, or a dispersant.

31. A composition according to claim 24 in which the dispersant is a copolymer of methacrylic acid and acrylamide.

32. A composition according to claim 24 in which the chelant is selected from the group consisting of N,N′-di(2-hydroxybenzyl)-trimethylenediamine-N,N′-diacetic acid, N,N′ethylenebis-[2-(2-hydroxy-4-methylphenyl)glycine], ethylenediamine, N,N′-bis-[2-hydroxyphenylacetic acid], or N,N-di(2-hydroxy-5-sulphonic acid benzyl)glycine.

33. A composition according to claim 24 in which the chelant is N,N-di(2-hydroxyethyl)glycine.

34. A composition according to claim 24 further comprising phosphate.

35. A composition according to claim 24 in which the weight ratio of chelant present in the composition to zinc salt present in the composition is between about 10:1 and about 1:1.

36. A composition according to claim 24 in which the product containing at least one phosphorus-containing acid group and at least one carboxylic acid group is a phosphino polycarboxylic acid having the formula

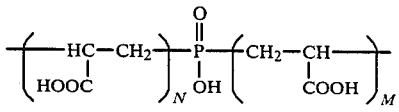

where N+M=4 to 20.

* * * * *